United States Patent [19]

Farmer

[11] Patent Number: 4,638,736

[45] Date of Patent: Jan. 27, 1987

[54] BOMBLET DISPERSION SYSTEM FOR A CLUSTER BOMB

[75] Inventor: James R. Farmer, Lititz, Pa.

[73] Assignee: ISC Technologies, Inc., Lancaster, Pa.

[21] Appl. No.: 591,608

[22] Filed: Mar. 20, 1984

[51] Int. Cl.[4] ..... F42B 25/02; F42B 25/16

[52] U.S. Cl. ..... 102/393; 102/489

[58] Field of Search ..... 102/393, 394, 396, 489; 89/1.56

[56] References Cited

U.S. PATENT DOCUMENTS

| | | | |
|---|---|---|---|
| 2,348,240 | 5/1944 | Braun | 102/393 |
| 2,434,162 | 1/1948 | Imber | 102/393 |
| 2,972,946 | 2/1961 | Poulter | 102/393 |
| 3,093,072 | 6/1963 | Pigman | 102/393 |
| 3,980,019 | 9/1976 | Anderson et al. | 102/393 |
| 4,125,310 | 11/1978 | Reardon, II et al. | 339/92 |
| 4,172,407 | 10/1979 | Wentink | 89/1.56 |
| 4,178,851 | 12/1979 | Brady | 102/393 |
| 4,231,293 | 11/1980 | Dahn et al. | 102/393 |
| 4,480,552 | 11/1984 | Eckel et al. | 102/489 X |

FOREIGN PATENT DOCUMENTS

| | | | |
|---|---|---|---|
| 2903938 | 8/1980 | Fed. Rep. of Germany | 102/393 |

OTHER PUBLICATIONS

Hughes Gold Dot Interconnection System Advertisement.

*Primary Examiner*—David H. Brown
*Attorney, Agent, or Firm*—Koppel & Harris

[57] ABSTRACT

Each bomblet within a cluster bomb is provided with an individually programmable detonation time delay, such that the bomblets can be programmed to detonate at desired intervals over a relatively long period of time. Program signals are transmitted to a number of bomblets at the same time from a wire that runs through openings in the bomblets, but is not mechanically attached to the bomblets. The wire is attached to the bomb canister at selected points and is severed inbetween the connection points when the canister is opened, thus permitting the wire sections to be pulled away without disrupting the bomblets' dispersion pattern. A shaped charge running along at least one of the canister sections is used to sever the wire. The shaped charge is arranged to direct its explosive force toward the adjacent canister section and generally away from the bomblets, and generally comprises a chevron-shaped casing filled with an explosive.

6 Claims, 6 Drawing Figures

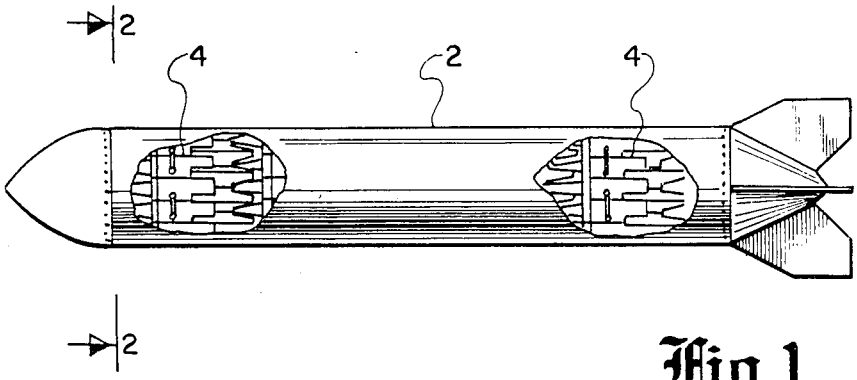
Fig.1.
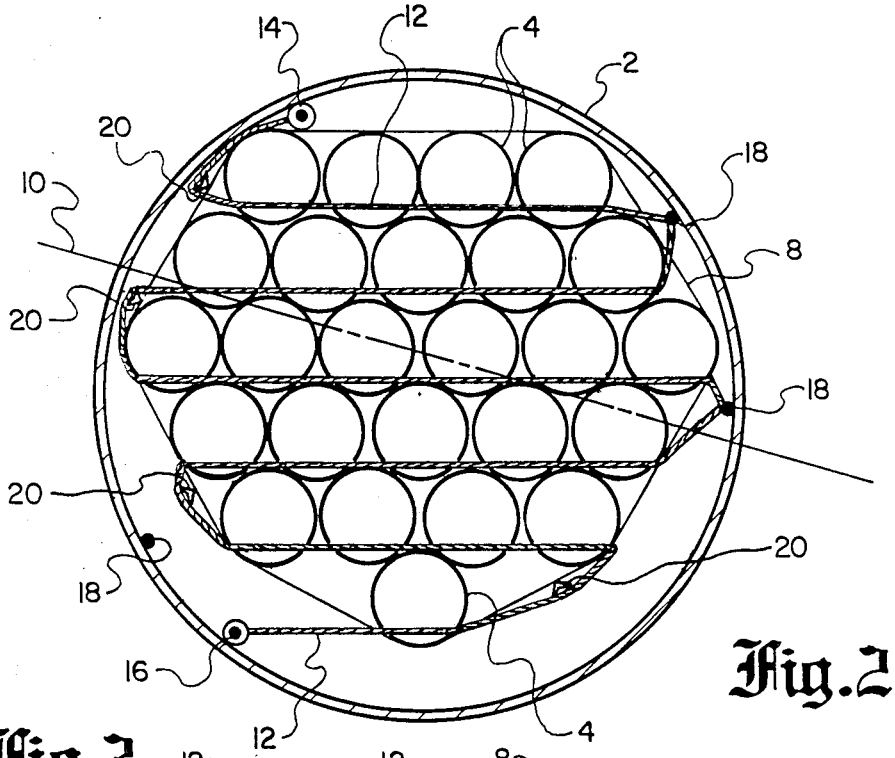
Fig.2.
Fig.3.
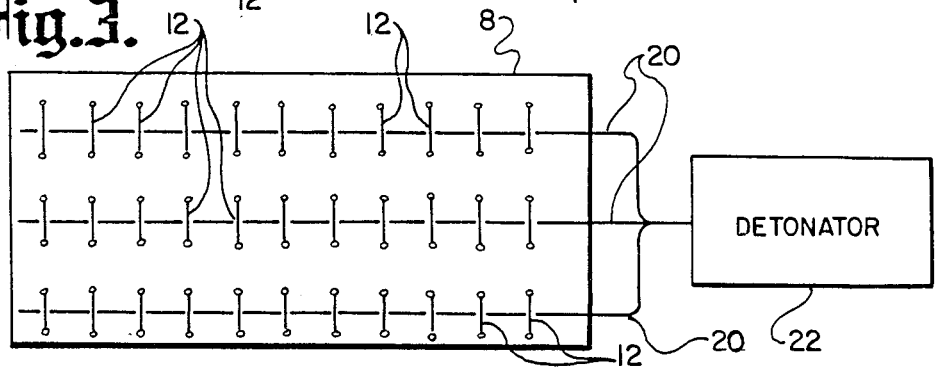

BOMBLET DISPERSION SYSTEM FOR A CLUSTER BOMB

BACKGROUND OF THE INVENTION

1. Field of the Invention

This invention relates to cluster bombs, and more particularly to cluster bombs having facilities for communicating with each of the individual bomblets which are released when the bomb is dropped.

2. Description of the Prior Art

Cluster bombs have been used for some time to provide area coverage from a single bomb drop. Up to several hundred bomblets are carried within a single outer housing or canister, which separates into two parts when dropped from an aircraft and releases the bomblets. The individual bomblets ideally fall in a predetermined dispersion pattern to cover a large area. Some cluster bombs have no facilities for communicating with individual bomblets, and the bomblets explode upon impact or after a built-in delay period. In a more sophisticated type of cluster bomb, each of the individual bomblets is connected to a central controller by means of a wire harness, with separate cables running from the harness to each individual bomblet. The use of such cables makes it possible to communicate with the bomblets after they have been positioned in the bomb canister, for purposes such as arming the bomblets or providing a common detonation delay time to each of the bomblets.

While the use of such wire harness connections provides greater versatility in the applications for which the cluster bomb may be used, it also limits the performance of the bomb. It is generally desirable that the bomblet dispersion pattern be homogeneous over a large area. The forces acting on the bomblets as they are released from the cluster bomb are critical in determining the dispersion pattern, with only a few ounces of force on each bomblet being sufficient to greatly distort the pattern. One problem with the prior art wire harness approach has been that, in order to provide communication with the bomblets, the wire harnesses have had their cables mechanically connected directly to each bomblet. When the bomblets are released, they must then be disconnected from their respective cables in order to fall freely. Various attempts have been made to disconnect the bomblets without adversely effecting their dispersion pattern, but none have been entirely successful.

In one prior art arrangement, an explosive device is provided on each bomblet to separate the bomblet from its electrical cable upon bomb release. While this approach effectively disconnects the cable, the explosive devices impose relatively large forces upon their respective bomblets which tend to spoil the dispersion pattern. Low force mechanical separation devices have also been proposed, but connectors with such devices tend to be quite unreliable, and can still significantly disrupt the dispersion pattern. Another problem is that, if too much force is imparted to the bomblets when they are released, the bomblets can tumble as they drop. Since the bomblets are generally armed by a rotating fin arrangement that is turned by air pressure as the bomblets rapidly fall and causes an arming mechanism to activate, a tumbling motion can keep the fins from rotating and thereby prevent the bomblet from arming.

In addition to the separation problems mentioned above, the wire harness approach is quite expensive, in large part because it requires a separate cable for each of typically several hundred bomblets.

In a companion U.S. patent application by Edward V. LaBudde, Ser. No. 590,215, filed Mar. 16, 1984, and entitled "Cluster Bomb System and Method", a new type of cluster bomb is described in which each of the bomblets is provided with an individual programmable detonator control. A signal transmission means electromagnetically transmits program information signals to the vicinity of each bomblet, while an electromagnetic signal coupler within each bomblet provides an interface between the transmission means and the detonator control to program the detonator control in response to program information signals delivered by the transmission means. In the preferred embodiment the signal transmission means is an electrically conductive wire positioned adjacent to, but mechanically detached from, each of the bomblets. The wire serves as a primary transformer winding, each bomblet being provided with a multi-turn secondary winding to receive signals from the wire. The wire preferably extends through an opening in each bomblet, with the secondary windings disposed around the periphery of the openings. In order to rapidly pull the wire away when the bomb canister opens without imparting any significant force to the bomblets, the wire is mechanically attached to the canister at selected locations, and the canister is adapted upon opening to sever the wire and pull it away from the bomblets.

SUMMARY OF THE INVENTION

The present invention provides a novel and improved mechanism for severing the transmission wire used in the LaBudde invention when the canister is opened. The present invention is described in the companion LaBudde application as a preferred implementation arrangement.

The object of the present invention is the provision of a novel and improved mechanism for rapidly severing the signal transmission wire of a LaBudde-type cluster bomb at a relatively large number of locations, insuring that the wire is completely cut at each location without causing any damage to the adjacent bomblets.

In the accomplishment of these and other objects of the invention, the transmission wire is arranged in a serpentine path adjacent the bomblets, and attached to at least one of the canister sections at a plurality of selected locations. A shaped charge explosive is positioned adjacent the transmission wire between each successive pair of attachment locations. The explosive is detonated when the canister opens, thereby severing the transmission wire between its attachment locations and enabling the resulting wire sections to be pulled away from the bomblets by at least one of the canister sections.

In a preferred embodiment, the shaped charge is chevron-shaped and positioned to direct its explosive force toward the adjacent canister section and generally away from the bomblets. The transmission wire is brought around the shaped charge at the desired severence points to ensure that it is completely cut.

These and other objects of the invention will be apparent to those skilled in the art from the ensuing description of preferred embodiments, taken together with the accompanying drawings, in which:

DESCRIPTION OF THE DRAWINGS

FIG. 1 is a partially cutaway plan view of a cluster bomb constructed in accordance with the invention;

FIG. 2 is a sectional view taken along the lines 2—2 of FIG. 1, showing the relative disposition of bomblets stacked within the cluster bomb, and the transmission wire used to communicate with the bomblets;

FIG. 3 is a somewhat diagrammatic plan view of the outside of a dunnage bag which holds the bomblets within the bomb canister, showing exposed portions of the transmission wire and a detonator cord used to cut the wire;

DETAILED DESCRIPTION OF PREFERRED EMBODIMENTS

Figures 4, 5, 6:
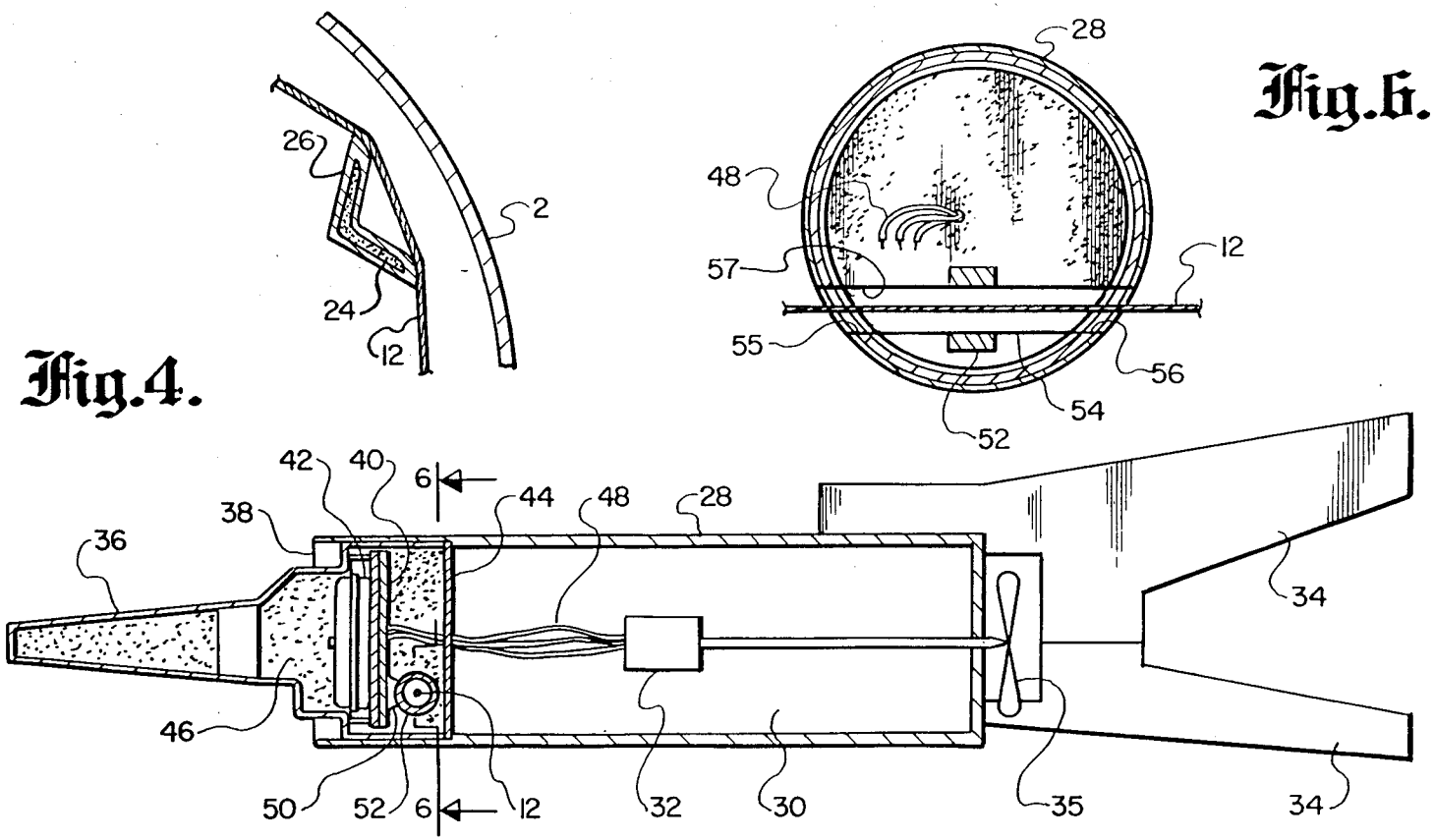
FIG. 4 is a fragmentary sectional view showing the transmission wire and the detonator cord used to cut the wire.
FIG. 5 is a sectional view of a bomblet constructed in accordance with the invention.
FIG. 6 is a sectional view taken along the lines 6—6 of FIG. 5.

Referring first to FIG. 1, a cluster bomb employing the concepts of the present invention is shown. The bomb consists of an outer housing or canister 2 which separates into two halves in a conventional manner upon being dropped from an aircraft. Within the bomb are multiple ranks of bomblets 4 which are stacked in tight packs so that up to several hundred bomblets can be packaged within the outer canister.

A cross-sectional view of one of the stacks of bomblets is illustrated in FIG. 2. The bomblets 4 are stacked so that they generally conform to the shape of the canister 2, with a foam dunnage bag 8 enclosing the bomblets and separating them from the canister wall. The axis of separation along which the bomb canister divides into two longitudinal halves when dropped from an aircraft, permitting the bomblets to be released from the canister and dunnage bag and dispersed over an area, is shown by dashed line 10.

A transmission wire 12, which enables communication with and individual programming of each of the bomblets, is wound through the interior of the canister in a serpentine fashion, in and out of the dunnage bag, so that it passes adjacent to each of the bomblets in the stack. The wire is physically detached from each of the bomblets but, as best illustrated in FIG. 6, actually passes through openings in each of the bomblets to ensure that the wire is maintained in a desired position relative to the bomblets. Wire 12 is of any suitable form capable of transmitting appropriate signals to the bomblets and of being withdrawn from the bomblets as described hereinafter; in the particular embodiment illustrated the wire is formed from 22–24 gage stranded copper wire with a Teflon coating.

A very long, continuous wire 12 may be used for each of the bomblet stacks, with the wire running longitudinally down the bomb from stack to stack and wound back and forth through the bomblets of each stack, or a bundle of wires may be employed with one wire used for each stack. The latter approach is used in the embodiment of FIG. 2; wire 12 is taken at the top of the bomblet stack from a bundle of wires 14 extending from a common signal generator, and at the bottom of the stack is returned to a bundle of wires 16 which return to the signal generator. Each of the wires in bundles 14 and 16 is wound in serpentine fashion through a respective stack of bomblets. Since each wire in the bundle is connected to carry the same signals as the other wires in the bundle, the bundled arrangement shown in FIG. 2 is functionally equivalent to a single wire which extends through all of the bomblet stacks.

Transmission wire 12 is bonded to the bomb canister 2 at selected spaced locations 18. In between the bonding locations a mechanism is provided external to the dunnage bag to break the wire when the canister opens and releases the bomblets. This allows the separating halves of the bomb canister to easily pull the severed wire sections away from the bomblets, permitting the bomblets to fall in a desired dispersion pattern and at the same time avoiding the application of any significant wire separation forces that might distort the dispersion pattern. While various cutting devices, such as mechanical shears, could be used, linear shaped detonating charges 20 which run along the inside of the canister from stack to stack have provided the best results. The shaped charges are preferably glued into slots cut into the dunnage.

The disposition of the transmission wires 12 and shaped charges 20 along the inside of the bomb canister is illustrated in FIG. 3, in which the bomblets are obscured by dunnage bag 8. The exposed portions of the transmission wire 12 are the loops which extend out of the dunnage bag at the end of a row of bomblets and then re-enter the bag at another row of bomblets. The shaped charges 20 extend longitudinally along the length of the bomb, with one shaped charge positioned adjacent each series of transmission wire loops. The shaped charges are controlled by a detonator 22, which causes them to detonate and sever the transmission wire at the moment the bomb canister begins to separate.

The shaped charge, shown in detail in FIG. 4, preferably comprises a chevron-shaped casing 26 which is extruded from aluminum or lead, filled with an explosive 24, and directs the blast force of the charge. Casing 26, which preferably has an angle of about 120°, is angularly positioned with its legs against the transmission wire, directing the blast from the detonator cord toward the adjacent wall of the bomb canister 2 and generally away from the bomblets, and thus preventing damage to the bomblets. A satisfactory shaped charge is provided by the Ensign Bickford Company under model number FLSC C-IV, seven grain per foot lead sheath.

The individual bomblets are similar in design, and are illustrated in FIGS. 5 and 6. Each bomblet has an outer shell 28, the rear portion of which encloses an explosive 30 which is set off by a detonator 32. At the rear of the bomblet is a set of fins 34 which stabilize the bomblet as it drops through the air. A rotating air vane assembly 35 causes the bomblet to be armed as it drops through the air, and closes a connection to an internal battery which powers a detonation timing mechanism, described in greater detail hereinafter.

A nose section 36 projects from the forward end of the bomblet and is held onto the remainder of the bomblet by means of a retaining ring 38. An electrical circuit board 40 is mounted within the bomblet forward of the explosive section, with the timing control circuitry of the present invention carried on one side of the board and a battery 42 mounted on the opposite side. The forward section of the bomblet is separated from the explosive material by a bulkhead wall 44, with most of its interior filled by a potting compound 46. A set of wires 48 extends through the bulkhead wall to connect battery 42 with detonator 32, under the control of the timing circuitry.

Extending toward the bulkhead from one side of the printed circuit board 40 is a core 50, about which a multi-turn toroid 52 is wound. The interior of the core is open, permitting the transmission wire 12 to extend through the core opening 54 between aligned openings 55,56 in the bomblet shell. The transmission wire 12 extends through a channel 57 in the potting compound from one side of the bomblet to the other, and communicates with the electronics within the bomblet by serving as a single turn transformer primary winding. The toroid 52 forms a secondary winding which is electromagnetically coupled with the primary winding wire 12. The toroid 52 preferably has about 300 turns, thus establishing a 1:300 turns ratio for the transformer. The toroid wire is connected to the circuitry on the printed circuit board 40 and provides the means by which signals applied to the transmission wire 12 are delivered to the circuitry within each bomblet, without any mechanical connection between the wire 12 and the bomblets.

While an inductive transformer coupling mechanism is preferred, other means for electromagnetically coupling a remote transmission facility with control circuitry within each of the bomblets might be used, such as capacitive or radio frequency coupling mechanisms. The advantage of an inductive coupling is that it is a relatively inexpensive, compact and efficient means for both transmitting information signals and transferring power to the bomblets. The power requirements of the present system are in the order of tens of milliwatts per bomblet, both during programming and after programming but before bomb release. The use of capacitive coupling, especially at the approximately 20–30 KHz frequency ranges envisioned for the data transmission employed in the invention, would require large surface areas to obtain the same efficiency over equivalent distances. Capacitive coupling would be more suitable at higher frequencies, in the megahertz range. With an efficiency of approximately 90% at a distance of about one-half inch, inductive coupling is superior within this range.

While particular embodiments of the invention have been shown and described, various modifications and alternate embodiments will occur to those skilled in the art. Accordingly, it is intended that the invention be limited only in terms of the appended claims.

I claim:

1. In a cluster bomb comprising a separable canister housing a plurality of bomblets, the canister being formed from a plurality of sections adapted to separate in flight, the bomblets being disposed within the canister to be dispersed over an area when the canister is opened, and a transmission wire arranged in a serpentine path adjacent the bomblets to transmit information signals to the bomblets, the wire being attached to at least one of the canister sections at a plurality of selected locations, the improvement comprising:

explosive means positioned adjacent the transmission wire between successive pairs of attachment locations, and means for detonating the explosive means upon opening of the canister to sever the transmission wire between its attachment locations, and thereby enable the resulting wire sections to be pulled away from the bomblets by at least one of the canister sections.

2. The cluster bomb of claim 1, said explosive means comprising a linear shaped charge.

3. In a cluster bomb comprising a separable canister housing a plurality of bomblets, the canister being formed from a plurality of sections adapted to separate in flight, the bomblets being disposed within the canister to be dispersed over an area when the canister is opened, and a transmission wire arranged in a serpentine path between canister sections and running adjacent the bomblets to transmit information signals to the bomblets, the wire being attached to at least one of the canister sections at a plurality of selected locations, the improvement comprising:

a shaped charge extending along at least one of the canister sections and adjacent the transmission wire between successive pairs of attachment locations, said charge being shaped to concentrate its explosive force against the wire, and means for detonating said shaped charge upon opening of the canister to sever the transmission wire between its attachment locations, and thereby enable the resulting wire sections to be pulled away from the bomblets by at least one of the canister sections.

4. The cluster bomb of claim 3, said shaped charge being arranged to direct its explosive force toward the adjacent canister section and generally away from the bomblets.

5. The cluster bomb of claim 4, said shaped charge comprising a chevron-shaped casing filled with an explosive and directing its explosive force generally toward the open side of the casing.

6. The cluster bomb of claim 5, said casing having an angle of approximately 120°.

* * * * *